US005659661A

United States Patent [19]

Ozawa

[11] Patent Number: 5,659,661

[45] Date of Patent: Aug. 19, 1997

[54] SPEECH DECODER

[75] Inventor: Kazunori Ozawa, Tokyo, Japan

[73] Assignee: NEC Corporation, Tokyo, Japan

[21] Appl. No.: 355,305

[22] Filed: Dec. 12, 1994

[30] Foreign Application Priority Data

Dec. 10, 1993 [JP] Japan ..... 5-310523

[51] Int. Cl.[6] ..... G10L 9/00

[52] U.S. Cl. ..... 395/2.37

[58] Field of Search ..... 395/2.1, 2.32, 395/2.29, 2.28, 2.39, 2.31, 2.37; 381/36, 38, 47

[56] References Cited

U.S. PATENT DOCUMENTS

| | | | |
|---|---|---|---|
| 4,516,259 | 5/1985 | Yato et al. | 381/36 |
| 4,752,956 | 6/1988 | Sluitzer | 381/38 |
| 4,912,764 | 3/1990 | Hartwell et al. | 381/38 |
| 4,969,192 | 11/1990 | Chen et al. | 395/2.31 |
| 5,113,448 | 5/1992 | Nomura et al. | 381/47 |
| 5,195,168 | 3/1993 | Yong | 395/2 |
| 5,261,027 | 11/1993 | Taniguchi et al. | 395/2 |
| 5,295,224 | 3/1994 | Makamura et al. | 395/2.32 |
| 5,301,255 | 4/1994 | Nagai et al. | 395/2.39 |
| 5,339,384 | 8/1994 | Chen | 395/2.2 |
| 5,396,576 | 3/1995 | Miki et al. | 395/2.31 |
| 5,432,883 | 7/1995 | Yoshihara | 395/2.28 |
| 5,485,581 | 1/1996 | Miyano et al. | 395/2.32 |

OTHER PUBLICATIONS

Schroeder et al., Code–Excited Linear Prediction (CELP): High–Quality Speeech at Very Low Bit Rates, Proceedings: ICASSP, 1985, pp. 937–940.

Kleijn et al., Improved Speech Quality and Efficient Vector Quantization in Selp, Proceedings: ICASSP, 1988, pp. 155–158.

Chen at al., Real–Time Vector APC Speech Coding at 4800 BPS with Adaptive Postfiltering, Proceedings: ICASSP, 1987, pp. 2185–2188.

Zwicker et al., *Psychoacoustics Facts and Models,* 1990, pp. 141–147.

Johnston, Transform Coding of Audio Signals Using Perceptual Noise Criteria, IEEE Journal on Selected Areas in Communications, Feb. 1988, vol. 6, No. 2, pp. 314–323.

*Primary Examiner*—Allen R. MacDonald
*Assistant Examiner*—Vijay B. Chawan
*Attorney, Agent, or Firm*—Foley & Lardner

[57] ABSTRACT

A speech decoder capable of auditorially reducing the quantization noise superimposed on the synthesized signal and improving a speech quality at lower bit rates is disclosed. A de-multiplexer unit 100 receives and separates an index concerning spectrum parameter, an index concerning amplitude, an index concerning pitch and an index concerning excitation signal. A synthesis filter unit 140 restores a synthesis filter drive signal based on the index concerning pitch, the index concerning excitation signal and the index concerning amplitude, forming the synthesis filter based on the index concerning spectrum parameter and obtaining a synthesized signal by driving the synthesis filter with the synthesis filter drive signal. A postfilter unit 200 receives the output signal of the synthesis filter and controls the spectrum of the synthesized signal. A filter coefficient calculation unit 210 derives an auditory masking threshold value from the synthesized signal and derives postfilter coefficients corresponding to the masking threshold value.

6 Claims, 5 Drawing Sheets

SPEECH DECODER

BACKGROUND OF THE INVENTION

The present invention relates to speech decoders for synthesizing speech by using indexes received from the encoding side and, more particularly, to a speech decoder which has a postfilter for improving a speech quality through control of quantization noise superimposed on synthesized signal.

As a system for encoding and transmitting a speech signal satisfactorily to certain extent at low bit rates, a CELP (Code-Excited Linear Prediction) system is well known in the art. For the details of this system, it is possible to refer to, for instance, M. Schroeder and B. Atal "Code-excited linear prediction: High quality speech at very low bit rates", Proc. ICASSP, pp. 937–940, 1985 (referred to here as Literature 1) and also to W. Kleijin et al "Improved speech quality and efficient vector quantization in SELP", Proc. ICASSP, pp. 155–158, 1988 (referred to here as Literature 2).

FIG. 1 shows a block diagram in the decoding side of the CELP method. Referring to FIG. 1, a de-multiplexer 100 receives an index concerning spectrum parameter, an index concerning amplitude, an index concerning pitch and an index concerning excitation signal from the transmitting side and separates these indexes. An adaptive codebook unit 110 receives the index concerning pitch and calculates an adaptive codevector z(n) based on formula (1).

$$z(n)=\beta(n-d) \tag{1}$$

Here, d is calculated from the index concerning pitch, and β is calculated from the index concerning amplitude. An excitation codebook unit 120 reads out corresponding codevector $S_j$ (n) from a codebook 125 by using the index concerning excitation, and derives and outputs excitation codevector based on formula (2).

$$r(n)=\gamma\cdot s_j(n) \tag{2}$$

Here, γ is a gain concerning excitation signal, as derived from the index concerning amplitude. An adder 130 then adds together z(n) in formula (1) and r(n) in formula (2), and derives a drive signal v(n) based on formula (3).

$$v(n)=z(n)+r(n) \tag{3}$$

A synthesis filter unit 140 forms a synthesis filter by using the index concerning spectrum parameter, and uses the drive signal for driving to derive a synthesized signal x(n) based on formula (4).

$$x(n)=v(n)+\sum_{i=1}^{M}\alpha'_i\cdot x(n-i) \tag{4}$$

Here, $\alpha'_i$ (i=1, . . . , M, M being the degree) is a linear prediction coefficient which has been restored from the spectrum parameter index in a spectrum parameter restoration unit 145. A postfilter 150 has a role of improving the speech quality through the control of the quantization complex noise that is superimposed on the synthesized signal x(n). A typical transfer function H(z) of the postfilter is expressed by formula (5).

$$H(z)=\left(\left[1-\sum_{i=1}^{M}\alpha'_i\gamma_1^i z^{-i}\right]/\left[1-\sum_{i=1}^{M}\alpha'_i\gamma_2^i z^{-i}\right]\right)[1-\eta z^{-i}] \tag{5}$$

Here, $\gamma_1$ and $\gamma_2$ are constants for controlling the degree of control of the quantization noise in the postfilter, and are selected to be $0<\gamma_1<\gamma_2<1$.

Further, η is a coefficient for emphasizing the high frequency band, and is selected to be $0<\eta<1$. For the details of the postfilter, it is possible to refer to J. Chen et al "Real-time vector APC speech coding at 4,800 bps with adaptive postfiltering", Proc. IEEE ICASSP, pp. 2,185–2, 188, 1987 (referred to here as Literature 3).

A gain controller 160 is provided for normalizing the gain of the postfilter. To this end, it derives a gain control volume G based on formula (6) by using short time power $P_1$ of postfilter input signal x(n) and short time power $P_2$ of postfilter output signal x'(n).

$$G=\sqrt{(P_1/P_2)} \tag{6}$$

Further, it derives and supplies gain-controlled output signal y(n) based on formula (7).

$$y(n)=g(n)\cdot x'(n) \tag{7}$$

Here, $$g(n)=(1-\delta)g(n-1)+\delta\cdot G \tag{8}$$

Here, δ is a time constant which is selected to be a positive minute quantity.

In the above prior art system, however, particularly in the postfilter the quantization noise control is dependent on the way of selecting γ 1 and γ 2 and has no consideration for the auditory characteristics. Therefore, by reducing the bit rate the quantization noise control becomes difficult, thus greatly deteriorating the speech quality.

SUMMARY OF THE INVENTION

An object of the present invention is therefore to provide a speech decoder capable of auditorially reducing the quantization noise superimposed on the synthesized signal.

Another object of the present invention is to provide a speech decoder with an improved speech quality at lower bit rates.

According to the present invention, there is provided a speech decoder comprising, a de-multiplexer unit for receiving and separating an index concerning spectrum parameter, an index concerning amplitude, an index concerning pitch and an index concerning excitation signal, a synthesis filter unit for restoring a synthesis filter drive signal based on the index concerning pitch, the index concerning excitation signal and the index concerning amplitude, forming the synthesis filter based on the index concerning spectrum parameter and obtaining a synthesized signal by driving the synthesis filter with the synthesis filter drive signal, a postfilter unit for receiving the output signal of the synthesis filter and controlling the spectrum of the synthesized signal, and a filter coefficient calculation unit for deriving an auditory masking threshold value from the synthesized signal and deriving postfilter coefficients corresponding to the masking threshold value.

According to another aspect of the present invention there is also provided a speech decoder comprising, a de-multiplexer unit for receiving and separating an index concerning spectrum parameter, an index concerning amplitude, an index concerning pitch and an index concerning excitation signal, a synthesis filter unit for restoring a synthesis filter drive signal based on the index concerning pitch, the index concerning excitation signal and the index concerning amplitude, forming the synthesis filter based on the index concerning spectrum parameter and obtaining a synthesized signal by driving the synthesis filter with the synthesis filter drive signal, a postfilter unit for receiving the output signal of the synthesis filter and controlling the spectrum of the synthesized signal, and a filter coefficient calculation unit for deriving the auditory masking threshold value according to the index concerning spectrum parameter and the postfilter coefficient corresponding to the masking threshold value deriving an auditory masking threshold value from the synthesized signal and deriving postfilter coefficients corresponding to the masking threshold value.

Other objects and features of the present invention will be clarified from the following description with reference to attached drawings.

DETAILED DESCRIPTION OF THE PREFERRED EMBODIMENTS

Figure 1:
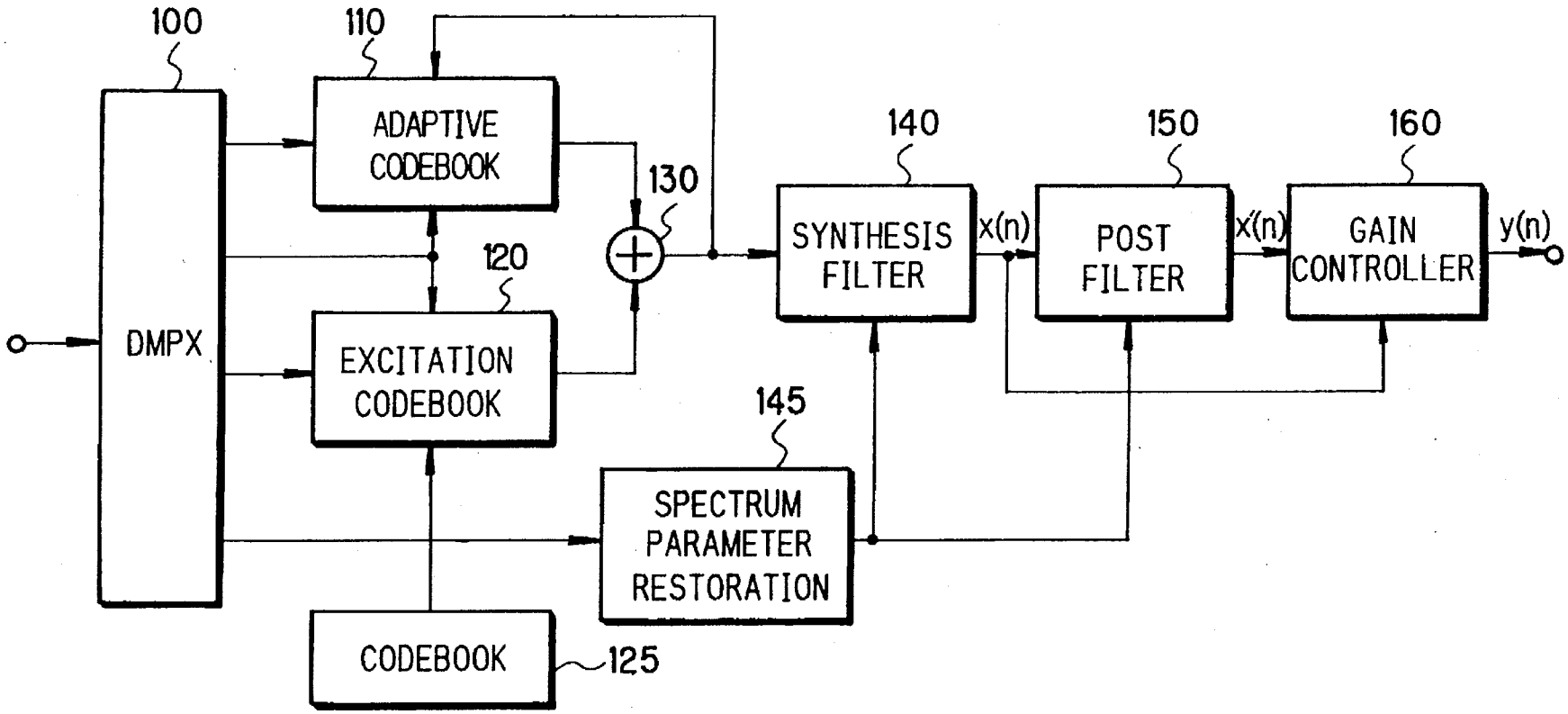
FIG. 1 shows a block diagram in the decoding side of the CELP method.

The functions of the speech decoder according to the present invention will be described. Main features of the present invention reside in the calculation of a filter coefficient reflecting auditory masking threshold value and the postfilter constitution using such coefficient. The other elements are similar to a constitution as in the prior art system shown in FIG. 1.

The filter coefficient calculation unit derives the postfilter coefficient from the auditory masking threshold value by taking the auditory masking characteristics into considerations. The postfilter shapes the quantization noise such that the quantization noise superimposed on the synthesized signal becomes less than the auditory masking threshold value, thus effecting speech quality improvement.

The filter coefficient calculation unit according to the present invention first derives the auditory masking threshold value from the synthesized signal x(n) and derives power spectrum through Fourier transform of the synthesized signal. Then, with respect to the power spectrum it derives the power sum for each critical band. As for the lower and upper limit frequencies of each critical band, it is possible to refer to E. Zwicker et al "Psychoacoustics", Springer-Verlag, 1990 (referred to here as Literature 4). Then, the unit calculates spreading spectrum through the convolution of spreading function on critical band power and calculates masking threshold value spectrum $P_{mi}$(i=1, . . . , B, B being the number of critical bands) through compensation of the spreading spectrum by a predetermined threshold value for each critical band. As for specific examples of the spreading function and threshold value, it is possible to refer to J. Johnston et al "Transform coding of Audio Signals using Perceptual Noise Criteria", IEEE J. Sel. Areas in Commun., pp. 314–323, 1988 (referred to here as Literature 5). After the transform of $P_{mi}$ to linear frequency axis, the unit calculates an auto-correlation function through the inverse Fourier transform. Then, it calculates L-degree linear prediction coefficients $b_i$ (i=1, . . . , L) from the auto-correlations at (L+1) points through a well-known linear prediction analysis. The coefficient $b_i$, which is obtained as a result of the above calculations, is a filter coefficient $b_i$ which reflects auditory masking threshold value.

In the postfilter unit, the transfer characteristic of the postfilter which uses filter coefficients based on the masking threshold value, is expressed by formula (9).

$$H(z)=\left(\left[1-\sum_{i=1}^{L} b_i\gamma_1^i z^{-i}\right]/\left[1-\sum_{i=1}^{L} b_i\gamma_2^i z^{-i}\right]\right)[1-\eta z^{-i}] \tag{9}$$

Here, $0<\gamma<\gamma_2<1$.

Further, in the filter coefficient calculation unit of the speech decoder system according to the present invention, in the Fourier transform derivation of the power spectrum it is possible not through Fourier transform of the synthesized signal x(n) but through Fourier transform of the linear prediction coefficient restored from the index concerning spectrum parameter to derive power spectrum envelope so as to calculate the masking threshold value.

Figure 2:
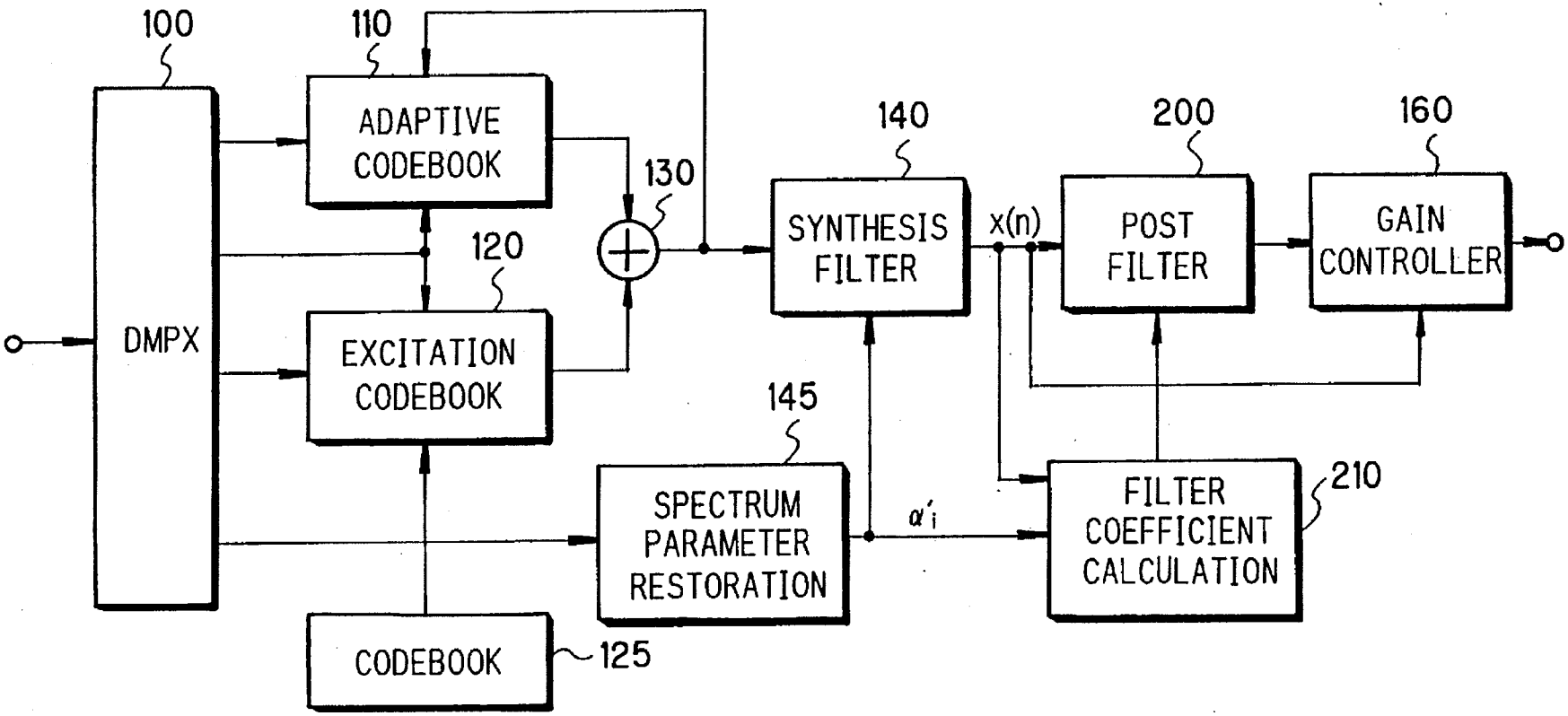
FIG. 2 is a block diagram showing a first embodiment of the speech decoder according to the present invention.
Figure 3:
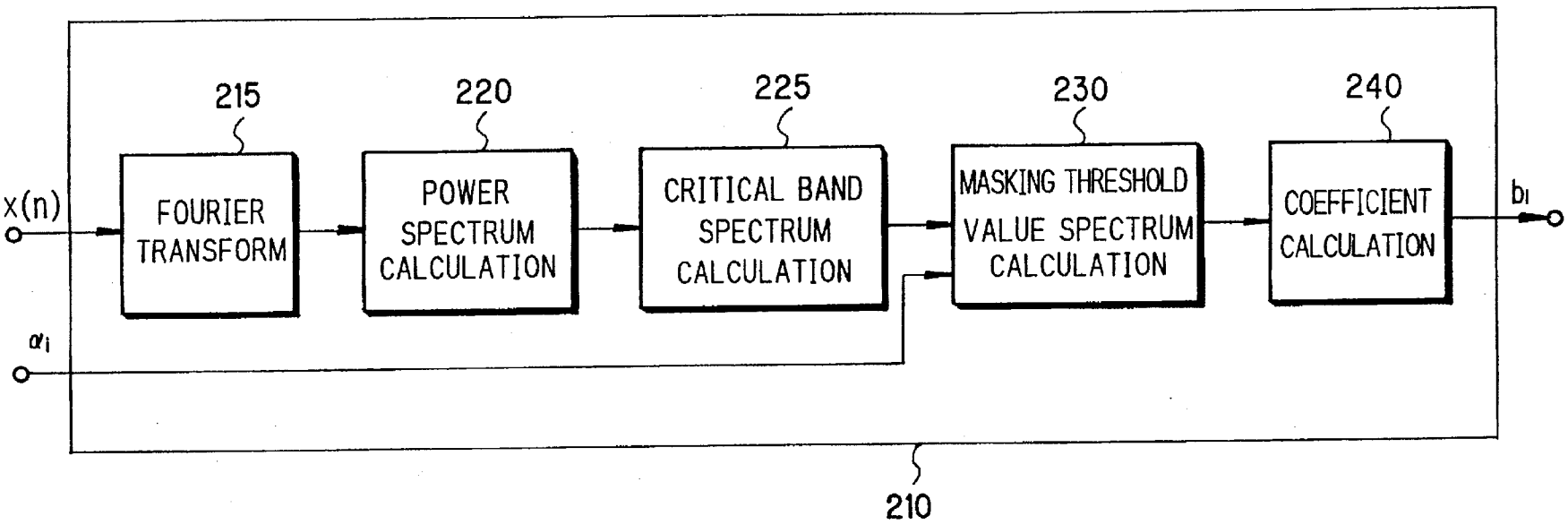
FIG. 3 shows a structure of the filter coefficient calculation unit 210 in FIG. 1.

FIG. 2 is a block diagram showing a first embodiment of the speech decoder according to the present invention. The elements designated by reference numerals like those in FIG. 1 perform like operations, so they are not described in detail. A filter coefficient calculation unit 210 stores the output signal x(n) of a synthesis filter 140 by a predetermined sample number. FIG. 3 shows the structure of the filter coefficient calculation unit 210.

Referring to FIG. 3, a Fourier transform unit 215 receives signal x(n) of predetermined number of samples and performs Fourier transform of predetermined number of points by multiplying a predetermined window function (for instance a Hamming window). A power spectrum calculation unit 220 calculates power spectrum P(w) for the output of the Fourier transform unit 215 based on formula (10).

$$P(w)=Re[X(w)]^2+Im[x(w)]^2 \quad (w=0 \ldots \pi) \tag{10}$$

Here, Re [X(w)] and Im [X(w)] represent the real and imaginary parts, respectively, of the Fourier transformed spectrum, and w represents the angular frequency. A critical band spectrum calculation unit 225 performs calculation of formula (11) using P(w).

$$B_i=\sum_{w=bl_i}^{bh_i} P(W) \tag{11}$$

Here, $B_i$ represents the critical band spectrum of the i-th band, and $bl_i$ and $bh_i$ are the lower and upper limit frequencies, respectively, of the i-th critical band. For specific frequencies, it is possible to refer to Literature 4.

Subsequently, convolution of spreading function on the critical band spectrum is performed based on formula (12).

$$C_i=\sum_{j=1}^{b_{max}} B_j sprd(j,i) \tag{12}$$

Here, sprd (j, i) represents the spreading function, and for its specific values it is possible to refer to Literature 4. Represented by $b_{max}$ is the number of critical bands included up to angular frequency $\pi$. The critical band calculation unit 225 produces $C_i$. A masking threshold value spectrum calculation unit 230 calculates masking threshold value spectrum. $Th_i$ based on formula (13).

$$Th_i = C_i T_i \tag{13}$$

Here, $$T_i = 10^{-(o_i/10)} \tag{14}$$

$$P^i = \alpha(14.5+i)+(1-\alpha)5.5 \tag{15}$$

$$\alpha = min[(NG/R), 1.0] \tag{16}$$

$$NG = 10\log_{10} \prod_{i=1}^{M} [1-k_i^2] \tag{17}$$

Here, $k_i$ represents k parameter of i-th degree to be obtained through the transform from the input linear prediction coefficient $\alpha'_i$ by a well-known method, M represents the degree of the linear prediction coefficient, and R represents a predetermined threshold value. The masking threshold value spectrum is expressed, with consideration of the absolute threshold value, by formula (18).

$$TH'_i = max[TH_i, absth_i] \tag{18}$$

Here, $absth_i$ represents the absolute threshold value in the i-th critical band, for which it is possible to refer to Literature 4.

A coefficient calculation unit 240 derives spectrum $P_m(f)$ with frequency axis conversion from the Burke axis to the Hertz axis with respect to masking threshold value spectrum $Th_i$ (i=1, . . . , $b_{max}$), then further derives auto-correlation function R(n) through the inverse Fourier conversion, and derives, for producing, filter coefficient $b_i$ (i=1, . . . ,L) from (L+1) points of R(n) through a well-known linear prediction analysis.

Referring back to FIG. 2, the postfilter 200 performs the postfiltering with the transfer characteristic expressed by formula (9) by using $b_i$.

Figure 4:
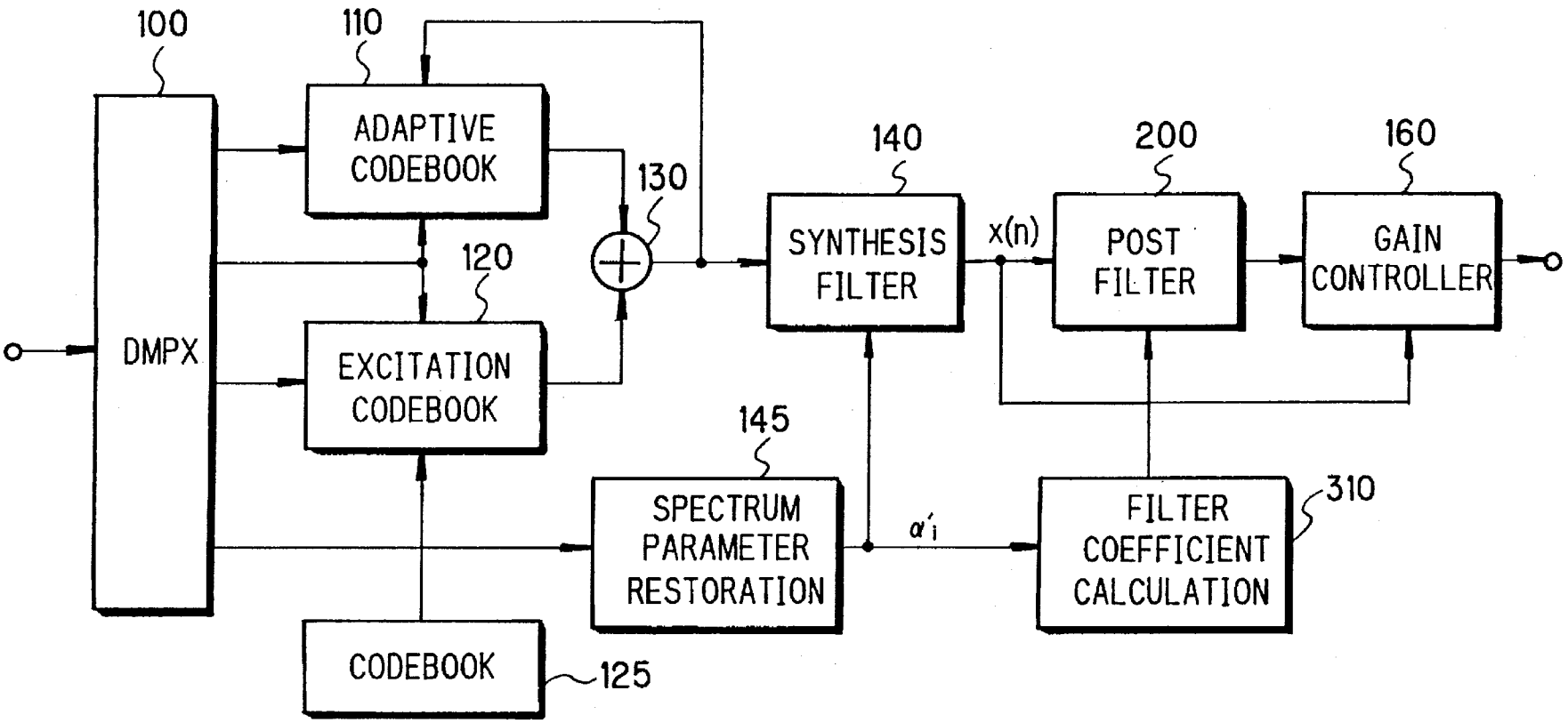
FIG. 4 is a block diagram showing a second embodiment of the present invention.

FIG. 4 is a block diagram showing a second embodiment of the present invention. Referring to FIG. 4, elements designated by reference numerals like those in FIGS. 1 and 2 perform like operations, o they are not described. The system shown in FIG. 4 is different from the system shown in FIG. 2 in a filter coefficient calculation unit 310.

Figure 5:
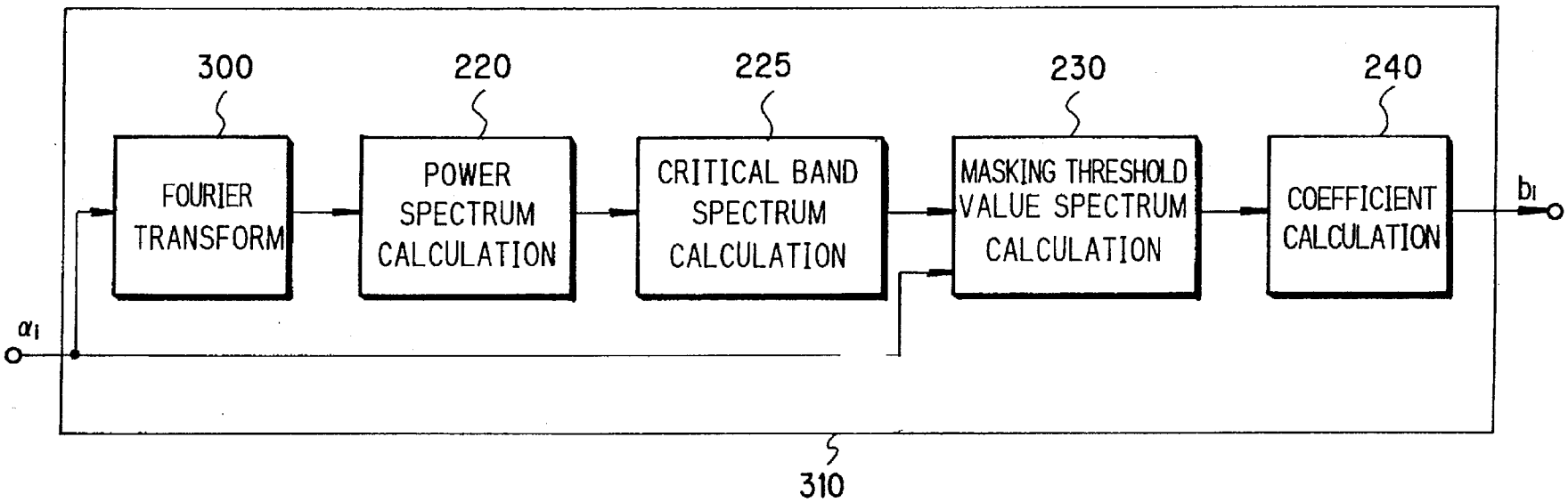
FIG. 5 shows the filter coefficient calculation unit 310 in FIG. 1.

FIG. 5 shows the filter coefficient calculation unit 310. Referring to FIG. 5, a Fourier transform unit 300 performs Fourier transform not on the speech signal x(n) but on spectrum parameter (here the linear prediction coefficient $\alpha'_i$).

The masking threshold value spectrum calculation in the above embodiments may be made by adopting other well-known methods as well. Further, it is possible as well for the filter coefficient calculation unit to use a band division filter group in place of the Fourier transform for reducing the amount of operations involved.

As has been described in the foregoing, according to the present invention auditory masking threshold value is derived from the synthesized signal obtained from the speech decoder unit or from the index concerning received spectrum parameter, filter coefficient reflecting the auditory masking threshold value is derived, and this coefficient is used for the postfilter. Thus, compared with the prior art system, it is possible to auditorially reduce the quantization noise that is superimposed on the synthesized signal. It is thus possible to obtain a great effect of speech quality improvement at lower bit rates.

Changes in construction will occur to those skilled in the art and various apparently different modifications and embodiments may be made without departing from the scope of the invention. The matter set forth in the foregoing description and accompanying drawings is offered byway of illustration only. It is therefore intended that the foregoing description be regarded as illustrative rather than limiting.

What is claimed is:

1. A speech decoder comprising:

a de-multiplexer unit for receiving and separating an index concerning spectrum parameter, an index concerning amplitude, an index concerning pitch and an index concerning excitation signal;

a synthesis filter unit for restoring a synthesis filter drive signal based on the index concerning pitch, the index concerning excitation signal and the index concerning amplitude, forming a synthesis filter based on the index concerning spectrum parameter and obtaining a synthesized signal by driving the synthesis filter with the synthesis filter drive signal;

a postfilter unit for receiving the output signal of the synthesis filter and controlling the spectrum of the synthesized signal; and a filter coefficient calculation unit for calculating linear transformation coefficients from the synthesized signal and deriving a set of auditory masking threshold values from said linear transformation coefficients from the synthesized signal and deriving postfilter coefficients corresponding to the auditory masking threshold values by performing an inverse linear transform of said auditory masking threshold values.

2. A speech decoder as set forth in claim 1, wherein said filter coefficient calculation unit performs Fourier transform from the synthesized signal to derive a power spectrum envelope so as to calculate the auditory masking threshold values.

3. A speech decoder comprising:

a de-multiplexer for receiving and separating an index concerning spectrum parameter, an index concerning amplitude, an index concerning pitch and an index concerning excitation signal;

a synthesis filter unit for restoring a synthesis filter drive signal based on the index concerning pitch, the index concerning excitation signal and the index concerning amplitude, forming a synthesis filter based on the index concerning spectrum parameter and obtaining a synthesized signal by driving the synthesis filter with the synthesis filter drive signal;

a postfilter unit for receiving the synthesized signal output from the synthesis filter and controlling the spectrum of the synthesized signal; and a filter coefficient calculation unit for calculating linear transformation coefficients from the index concerning spectrum parameter and deriving a set of auditory masking threshold values from said linear transformation coefficients and deriving postfilter coefficients corresponding to the auditory masking threshold values by performing an inverse linear transform of said auditory masking threshold values.

4. A speech decoder as set forth in claim 2, wherein said filter coefficient calculation unit performs Fourier transform from the synthesized signal to derive a power spectrum envelope so as to calculate the auditory masking threshold values.

5. A speech decoder comprising:

a de-multiplexer configured to receive and separate an index concerning spectrum parameter, an index concerning amplitude, an index concerning pitch and an index concerning excitation signal;

an adaptive codebook unit coupled to the demultiplexer and configured to receive the index concerning pitch and to calculate an adaptive codevector based on the index concerning pitch;

an excitation codebook configured to store a plurality of excitation codevectors;

an excitation codebook unit coupled to the excitation codebook and the de-multiplexer, the excitation codebook unit being configured to receive the index concerning excitation signal and to read out a corresponding excitation codevector from the excitation codebook by using the index concerning excitation signal;

an adder coupled to the adaptive codebook unit and the excitation codebook unit, the adder being configured to add the corresponding excitation codevector and the calculated adaptive codevector and to output a drive signal as a result;

a synthesis filter unit coupled to the adder and to the de-multiplexer, the synthesis filter unit being configured to form a synthesis filter by using the index concerning spectrum parameter, and to drive the synthesis filter using the drive signal, the synthesis filter unit obtaining a synthesized signal by driving the synthesis filter with the drive signal;

a postfilter unit coupled to the synthesis filter unit and configured to receive the synthesized signal and to control a spectrum of the synthesized signal based on filtering of the synthesized signal using postfilter coefficients; and a filter coefficient calculation unit coupled to the synthesis filter unit and the postfilter unit, the filter coefficient calculation unit being configured to calculate linear transformation coefficients from the index concerning spectrum parameter, to derive a set of auditory masking threshold values from the linear transformation coefficients, and to derive the postfilter coefficients which correspond to the auditory masking threshold values by performing an inverse linear transform of the auditory masking threshold values, the postfilter coefficients being sent to the postfilter unit.

6. A speech coder as set forth in claim 5, wherein said filter coefficient calculation unit comprises:

a fourier transform unit configured to receive the synthesized signal and to compute a frequency spectrum through a fourier transform of the synthesized signal;

a power spectrum calculation unit coupled to the fourier transform unit and configured to compute a power spectrum based on the fourier transform of the synthesized signal;

a critical band spectrum calculation unit coupled to the power spectrum calculation unit and configured to calculate a critical band spectrum for each critical band of the power spectrum;

a masking threshold value spectrum calculation unit coupled to the critical band spectrum calculation unit and configured to calculate the auditory masking threshold values based on the critical band spectrum for said each critical band of the power spectrum; and a coefficient calculation unit coupled to the masking threshold value spectrum calculation unit and configured to calculate postfilter coefficients corresponding to the masking threshold values by performing an inverse fourier transform of the auditory masking threshold values.

* * * * *